US008474436B2

(12) United States Patent
Mancini et al.

(10) Patent No.: US 8,474,436 B2
(45) Date of Patent: Jul. 2, 2013

(54) SILENCED FUEL PUMP FOR A DIRECT INJECTION SYSTEM

(75) Inventors: Luca Mancini, Budrio (IT); Paolo Pasquali, Castelmaggiore (IT); Riccardo Marianello, Monte San Pietro (IT)

(73) Assignee: Magneti Marelli S.p.A. (IT)

( * ) Notice: Subject to any disclaimer, the term of this patent is extended or adjusted under 35 U.S.C. 154(b) by 0 days.

(21) Appl. No.: 13/440,582

(22) Filed: Apr. 5, 2012

(65) Prior Publication Data

US 2012/0255636 A1 Oct. 11, 2012

(30) Foreign Application Priority Data

Apr. 7, 2011 (IT) ..... BO2011A0183

(51) Int. Cl.
*F02M 37/06* (2006.01)

(52) U.S. Cl.
USPC ..... 123/446; 123/456; 123/458; 123/500; 123/510

(58) Field of Classification Search
USPC ..... 123/446, 456, 458, 500–503, 510
See application file for complete search history.

(56) References Cited

U.S. PATENT DOCUMENTS

| | | | | |
|---|---|---|---|---|
| 7,975,674 | B2 * | 7/2011 | Kylstrom et al. | 123/495 |
| 8,342,151 | B2 * | 1/2013 | Gwidt et al. | 123/357 |
| 2006/0118089 | A1 * | 6/2006 | Tokuo et al. | 123/458 |
| 2008/0264386 | A1 * | 10/2008 | Watanabe et al. | 123/456 |
| 2009/0126688 | A1 * | 5/2009 | Borg et al. | 123/446 |
| 2009/0241908 | A1 * | 10/2009 | Tokuo et al. | 123/476 |
| 2010/0043759 | A1 * | 2/2010 | Kylstrom et al. | 123/495 |

FOREIGN PATENT DOCUMENTS

| | | | |
|---|---|---|---|
| EP | 1072781 | A2 | 1/2001 |
| EP | 2063100 | A2 | 11/2008 |
| EP | 2236809 | A2 | 3/2010 |
| EP | 2256334 | A1 | 12/2010 |

OTHER PUBLICATIONS

Aug. 4, 2011 Search Report for Italian Patent App. No. IT B020110183.

* cited by examiner

*Primary Examiner* — Erick Solis
(74) *Attorney, Agent, or Firm* — Bliss McGlynn, P.C.

(57) ABSTRACT

A fuel pump for a direct-injection system provided with a common rail comprises a pumping chamber defined in a main body. A piston is mounted in a sliding manner inside the pumping chamber to cyclically vary volume of the pumping chamber. A suction channel is connected to the pumping chamber and regulated by a suction valve. A delivery channel is connected to the pumping chamber and regulated by a delivery valve. A flow-rate-adjustment device is mechanically coupled to the suction valve to keep, when necessary, the suction valve substantially open during pumping of the piston and includes a control rod that is coupled to the suction valve and an electromagnetic actuator that acts on the control rod and has a one-way hydraulic brake that is integral to and substantially slows movement of the control rod.

7 Claims, 7 Drawing Sheets

SILENCED FUEL PUMP FOR A DIRECT INJECTION SYSTEM

REFERENCE TO RELATED APPLICATION

This application claims benefit of the filing date of and priority to Italian Patent Application BO2011A 000183 filed on Apr. 7, 2011.

BACKGROUND OF INVENTION

1. Field of Invention

The present invention relates to, in general, a fuel pump and, in particular, one for a direct-injection system.

2. Description of Related Art

A direct-injection system comprises a plurality of injectors, a common rail that feeds the fuel under pressure to the injectors, a high-pressure fuel pump that feeds the fuel to the common rail through a high-pressure feeding conduit and is provided with a flow-rate-adjustment device, and a control unit that pilots the flow-rate-adjustment device for keeping the fuel pressure inside the common rail equal to a desired-value generally time-course variable as a function of the operating conditions of the engine.

The high-pressure fuel pump described in Patent Application EP2236809A1 comprises a pumping chamber in which a piston slides with alternating motion, a suction channel regulated by a suction valve for feeding the low-pressure fuel inside the pumping chamber, and a delivery conduit regulated by a delivery valve for feeding the high-pressure fluid outside the pumping chamber and toward the common rail through the feeding conduit.

The suction valve is normally controlled under pressure and, in the absence of external actions, closed when the fuel pressure inside the pumping chamber is higher than that in the suction channel and open when the fuel pressure inside the pumping chamber is lower than that inside the suction channel. The flow-rate-adjustment device is mechanically coupled to the suction valve to keep, when necessary, the suction valve open during pumping of the piston and, thereby, allow the fuel flow to exit from the pumping chamber through the suction channel. In particular, the flow-rate-adjustment device comprises a control rod that is coupled to the suction valve and movable between a "passive" position, in which it allows the suction valve to close, and an "active" position, in which it does not allow the suction valve to close. The flow-rate-adjustment device comprises further an electromagnetic actuator that is coupled to the control rod for moving the control rod between the "active" and "passive" positions. The electromagnetic actuator comprises a spring that keeps the control rod in the "active" position and an electromagnet that is adapted to move the control rod to the "passive" position by magnetically attracting a ferromagnetic anchor integral with the control rod against a fixed magnetic armature.

It has been noted that, in use, the high-pressure fuel pump described in Patent Application EP2236809A1 produces a noise similar to a ticking that can be clearly perceived when the engine is at low revolution speeds (i.e., overall noise generated by the engine is poor). The noise generated by the high-pressure fuel pump can be clearly perceived also because, since the high-pressure fuel pump must take the motion from the driving shaft, it is directly mounted onto the engine head a motor head of which transmits and spreads the vibration generated by the high-pressure fuel pump.

The noise produced by the high-pressure fuel pump in use is essentially due to the cyclical impacts of the movable equipment of the flow-rate-adjustment device (i.e., control rod and the anchor) against the suction valve and magnetic armature of the electromagnet. To reduce such noise, it has been proposed to act via software on the intensity and waveform of the piloting current of the electromagnet to minimize the kinetic energy of the movable equipment upon the impact against the suction valve and magnetic armature. It has been experimentally noted that, by acting via software on the piloting current of the electromagnet, it is possible to considerably reduce the kinetic energy of the movable equipment upon the impact against the magnetic armature. Conversely, it has been experimentally noted that, by acting via software on the piloting current of the electromagnet, it is much more complex and expensive to considerably reduce the kinetic energy of the movable equipment upon the impact against the suction valve.

To considerably reduce the kinetic energy of the movable equipment upon the impact, the control system must energize the electromagnet with a piloting current that is as close as possible to the "limit" piloting current (which imparts the "minimum" kinetic energy to the movable equipment upon the impact). But, above all, the control system must energize the electromagnet with a piloting current that never drops below the "limit" piloting current, or the actuation is lost (i.e., movable equipment never reaches the desired position due to insufficient kinetic energy). The value of the "limit" piloting current is highly variable according to the case because of the construction leakages and drifts due to time and temperature. In the case of impact against the magnetic armature, the control system is facilitated since the reaching of the "limit" position (i.e., performance of the actuation) may be verified by observing the fuel pressure inside the common rail (when the control rod impacts against the magnetic armature, the suction valve closes and, thus, the high-pressure fuel pump starts pumping fuel under pressure, which increases the fuel pressure inside the common rail). Therefore, the control system can progressively decrease the piloting current until the reaching of the "limit" position (i.e., performance of the actuation) disappears. And, at this point, it can slightly increase the piloting current for carrying out the actuation with the "minimum" kinetic energy upon the impact. On the other hand, in the case of impact against the suction valve, there is no way to check the reaching of the limit position (i.e., performance of the actuation), and, thus, the control system must completely act in open ring, being definitely ineffective in limiting the kinetic impact energy and, therefore, noise.

Thus, there is a need in the related art for a fuel pump for a direct-injection system. More specifically, there is a need in the related art for such a fuel pump that is free from the above-described drawbacks and simple and inexpensive to make.

SUMMARY OF INVENTION

The invention overcomes the disadvantages in the related art in a fuel pump for a direct-injection system provided with a common rail. The fuel pump comprises a pumping chamber defined in a main body. A piston is mounted in a sliding manner inside the pumping chamber to cyclically vary volume of the pumping chamber. A suction channel is connected to the pumping chamber and regulated by a suction valve. A delivery channel is connected to the pumping chamber and regulated by a delivery valve. A flow-rate-adjustment device is mechanically coupled to the suction valve to keep, when necessary, the suction valve substantially open during pumping of the piston and includes a control rod that is coupled to the suction valve and an electromagnetic actuator that acts on the control rod and has a one-way hydraulic brake that is integral to and substantially slows movement of the control rod.

An advantage of the fuel pump for a direct-injection system of the invention is that it is free from the above-described drawbacks.

Another advantage of the fuel pump for a direct-injection system of the invention is that it is simple and inexpensive to make.

Other objects, features, and advantages of the fuel pump for a direct-injection system of the invention are readily appreciated as the fuel pump becomes more understood while the subsequent detailed description of at least one embodiment of the fuel pump is read taken in conjunction with the accompanying drawing thereof.

BRIEF DESCRIPTION OF EACH FIGURE OF DRAWING

DETAILED DESCRIPTION OF EMBODIMENT(S) OF INVENTION

Figure 1:
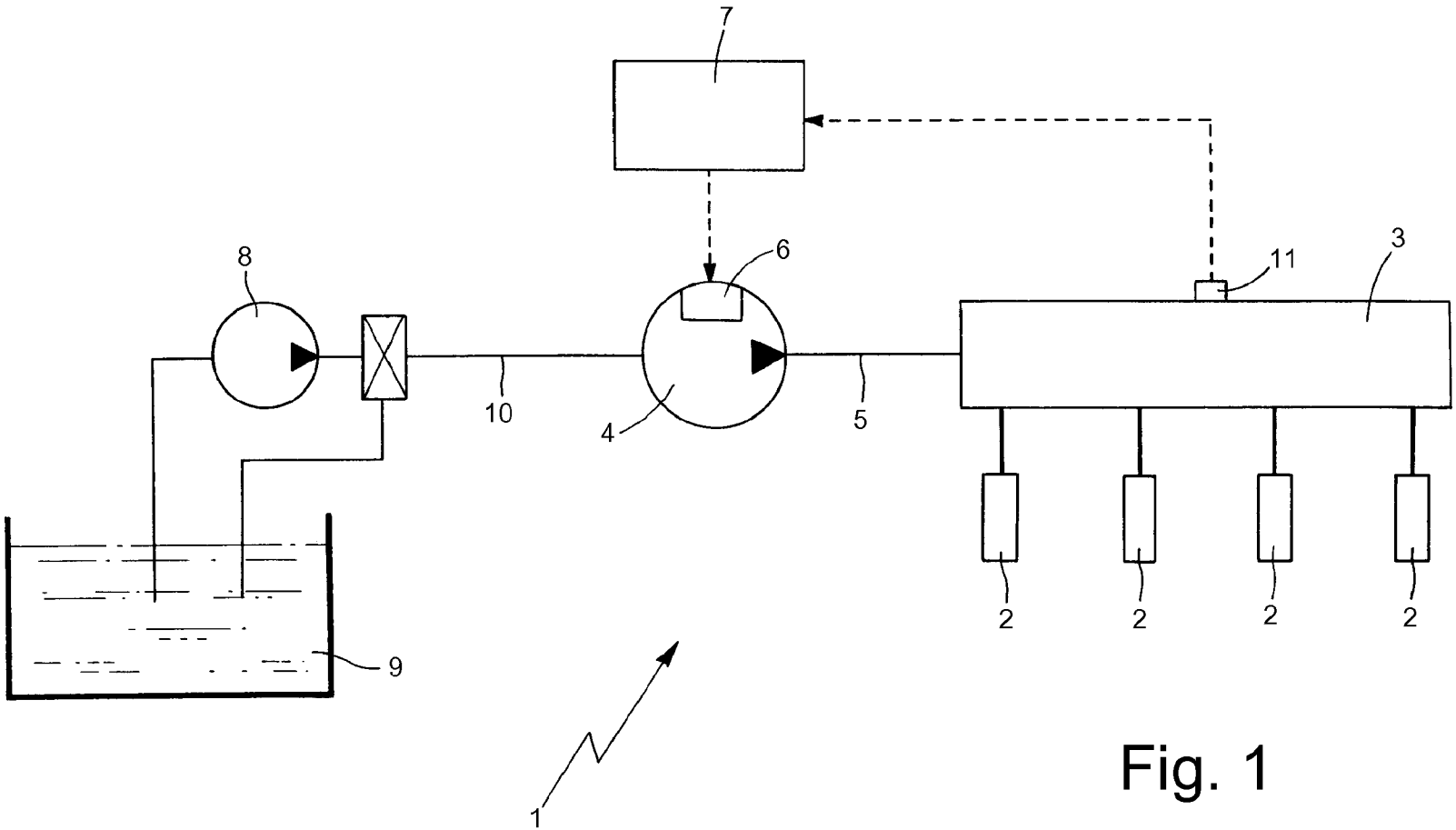
FIG. 1 is a schematic view of a direct-fuel-injection system of the common-rail type with details removed for clarity.

In FIG. 1, a direct-fuel-injection system of the common-rail type for an internal-combustion-heat engine is generally indicated at 1. The direct-injection system 1 comprises a plurality of injectors 2, common rail 3 that feeds the fuel under pressure to injectors 2, high-pressure pump 4 that feeds the fuel to the common rail 3 through a high-pressure feeding conduit 5 and is provided with a flow-rate-adjustment device 6, control unit 7 that keeps the fuel pressure inside the common rail 3 equal to a desired-value generally time-course variable as a function of the operating conditions of the engine, and low-pressure pump 8 that feeds the fuel from a tank 9 to the high-pressure pump 4 through a feeding conduit 10.

The control unit 7 is coupled to the flow-rate-adjustment device 6 for controlling the flow rate of the high-pressure pump 4 to continuously feed the common rail 3 with the amount of fuel required to have the desired pressure value inside the same common rail 3. In particular, the control unit 7 adjusts the flow rate of the high-pressure pump 4 through a feedback control using the fuel-pressure value inside the common rail 3 as a feedback variable, which value is detected in real time by a pressure sensor 11.

Figure 2:
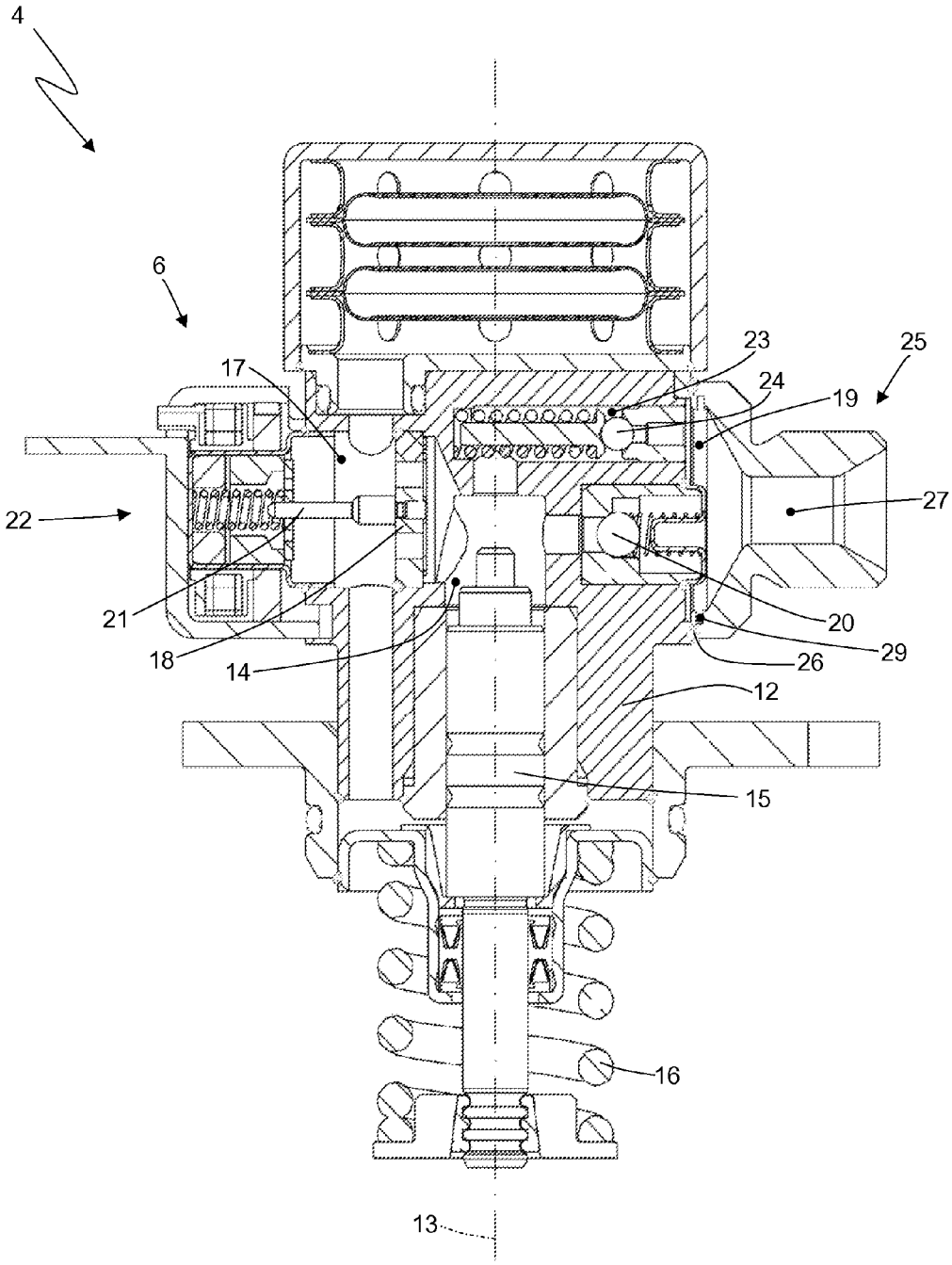
FIG. 2 is a schematic cutaway view of a high-pressure fuel pump of the direct-injection system of FIG. 1 with details removed for clarity.

As shown in FIG. 2, the high-pressure pump 4 comprises a main body 12 that defines a longitudinal axis 13 and a cylindrical pumping chamber 14. A piston 15 is mounted in a sliding manner inside the pumping chamber 14 and moves by an alternating motion along the longitudinal axis 13 to cyclically vary the volume of the pumping chamber 14. A lower portion of the piston 15 is on the one side coupled to a spring 16 that tends to push the piston 15 toward a position of maximum volume of the pumping chamber 14. On the other side, it is coupled to an eccentric (not shown) that is moved in rotation by a driving shaft of the engine for cyclically moving the piston 15 upward by compressing the spring 16.

A suction channel 17 originates from a side wall of the pumping chamber 14 and is connected to the low-pressure pump 8 through the feeding conduit 10 and regulated by a suction valve 18 arranged at the pumping chamber 14. The suction valve 18 is normally controlled under pressure and, in the absence of external actions, closed when the fuel pressure inside the pumping chamber 14 is higher than that in the suction channel 17 and open when the fuel pressure inside the pumping chamber 14 is lower than that inside the suction channel 17.

A delivery channel 19 originates from a side wall of the pumping chamber 14 and on the side opposite the suction channel 17 and is connected to the common rail 3 through the feeding conduit 5 and regulated by a one-way delivery valve 20 that is arranged at the pumping chamber 14 and only allows the fuel flow to exit from the pumping chamber 14. The delivery valve 20 is controlled under pressure and open when the fuel pressure inside the pumping chamber 14 is higher than that in the delivery channel 19 and closed when the fuel pressure inside the pumping chamber 14 is lower than that inside the delivery channel 19.

The flow-rate-adjustment device 6 is mechanically coupled to the suction valve 18 to allow the control unit 7 to keep, when necessary, the suction valve 18 open during pumping of the piston 15 and, thereby, a fuel flow to exit from the pumping chamber 14 through the suction channel 17. The flow-rate-adjustment device 6 comprises a control rod 21 that is coupled to the suction valve 18 and is movable between a "passive" position, in which it allows the suction valve 18 to close, and an "active" position, in which it does not allow the suction valve 18 to close. The flow-rate-adjustment device 6 comprises further an electromagnetic actuator 22 that is coupled to the control rod 21 for moving the control rod 21 between the "active" and "passive" positions.

Figure 3:
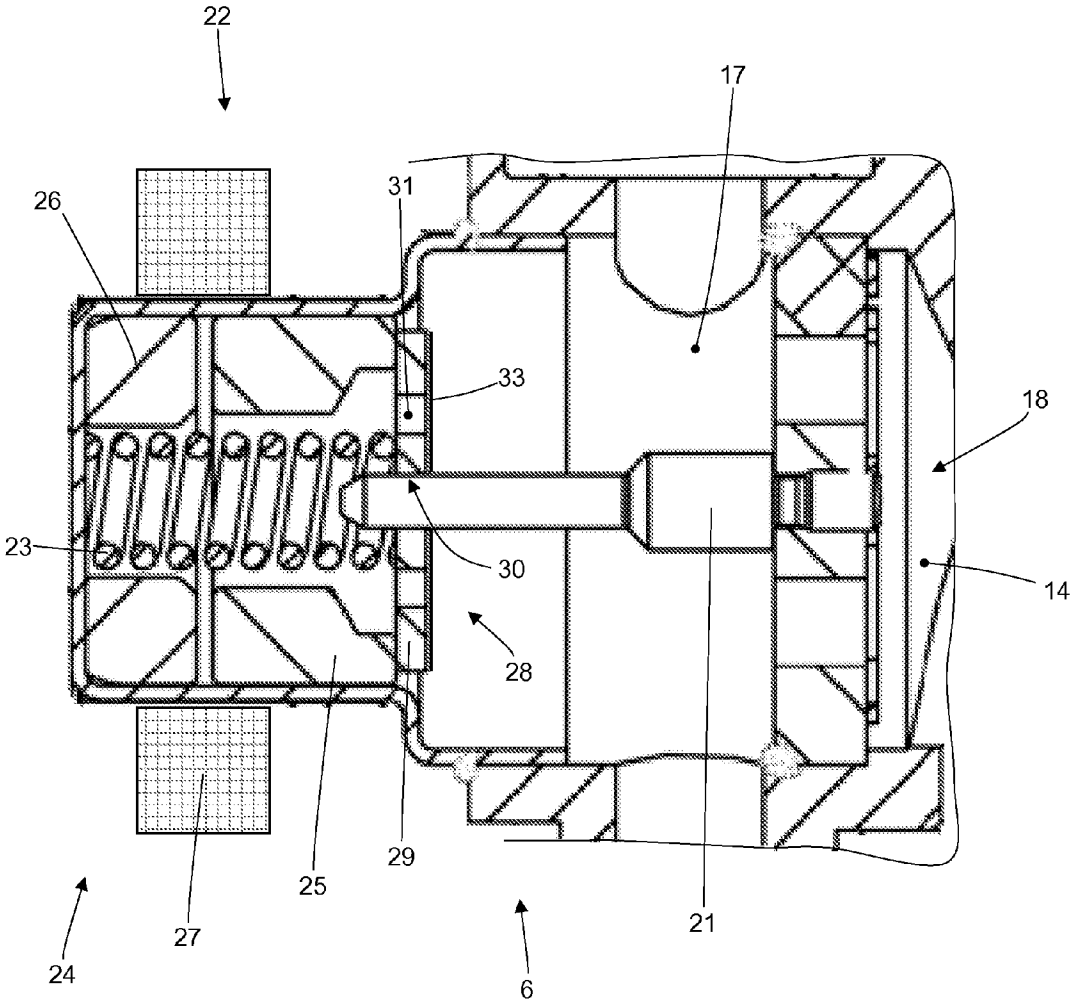
FIG. 3 is an enlarged scale view of a flow-rate-adjustment device of the high-pressure fuel pump of FIG. 2.
Figure 4:
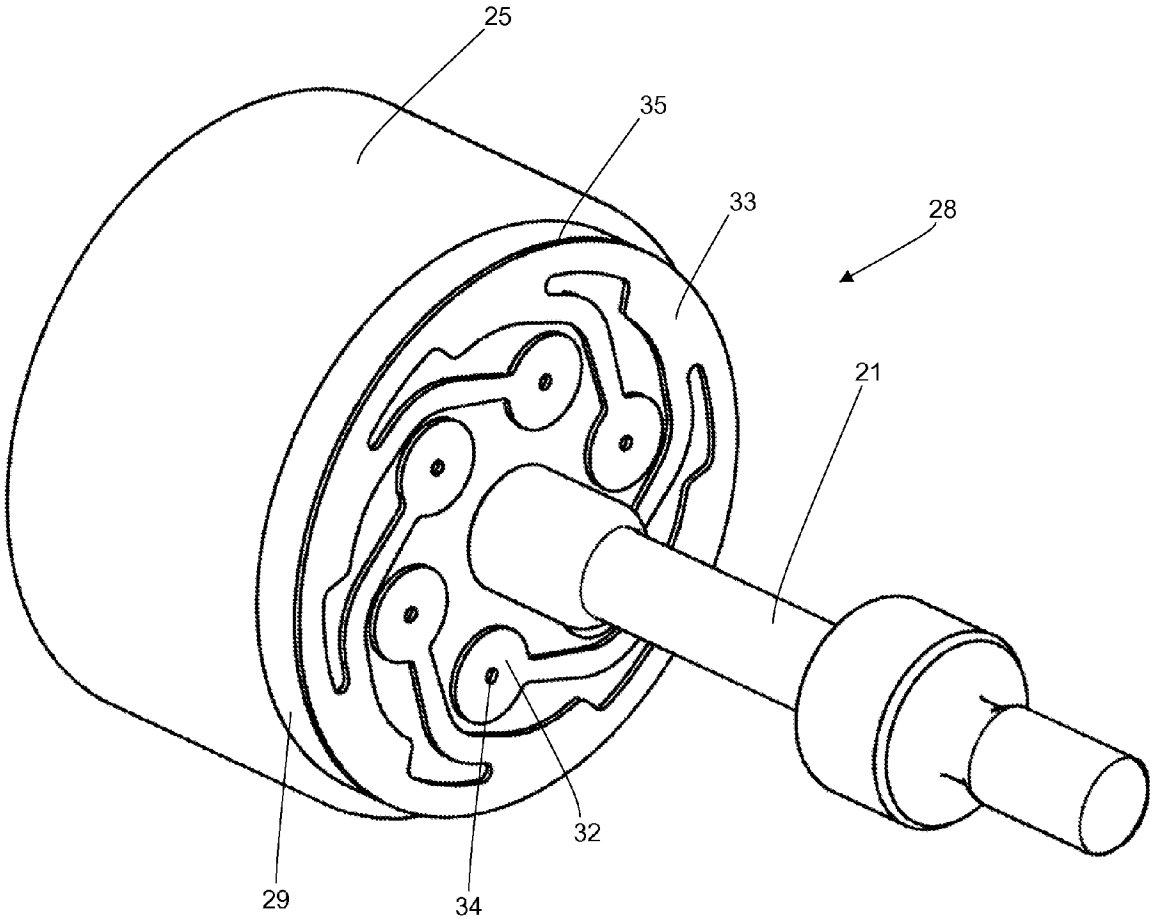
FIG. 4 is a perspective scale view of movable equipment of the flow-rate-adjustment device of FIG. 3.
Figure 5:
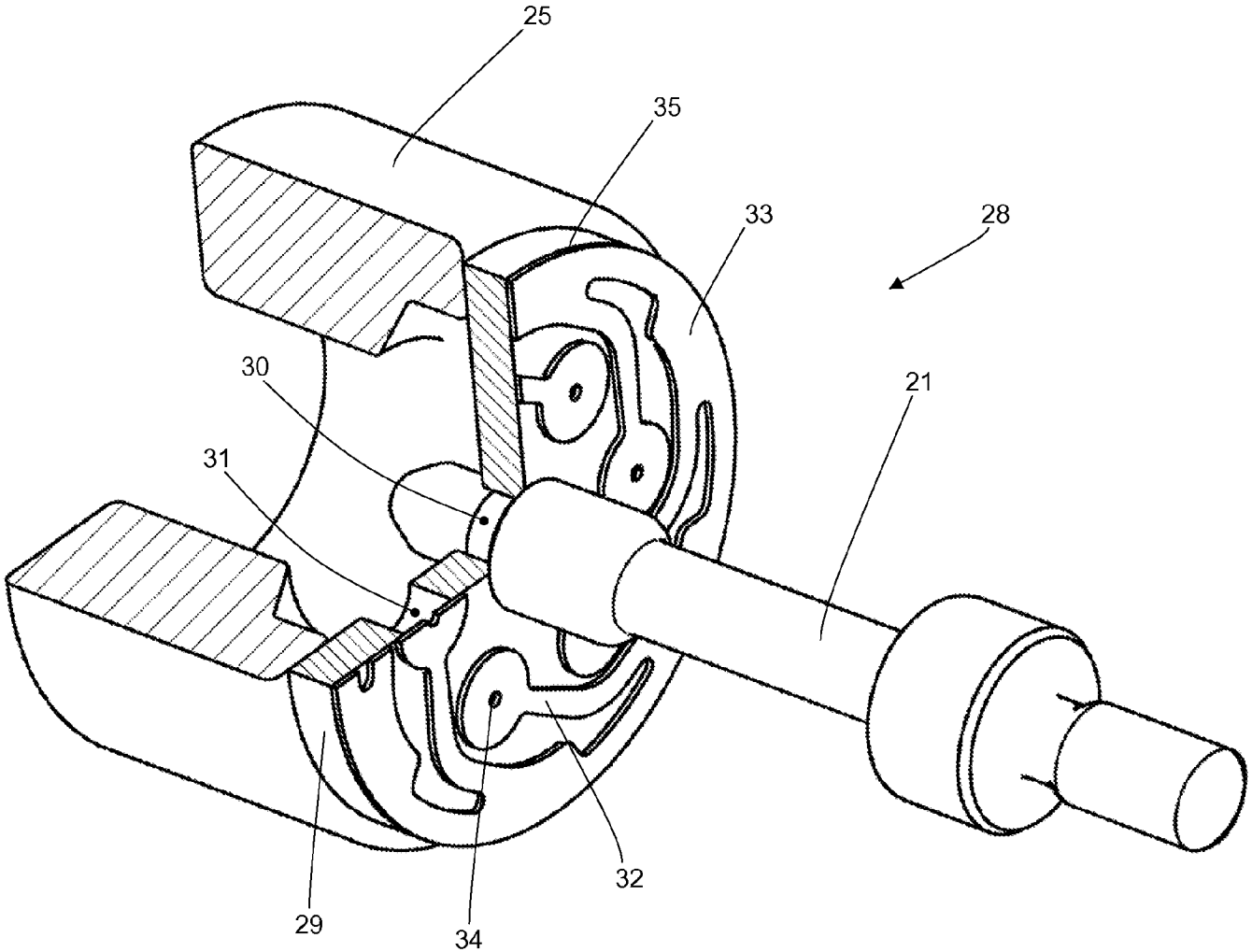
FIG. 5 is a perspective and partially cutaway view of the movable equipment of FIG. 4.
Figure 6:
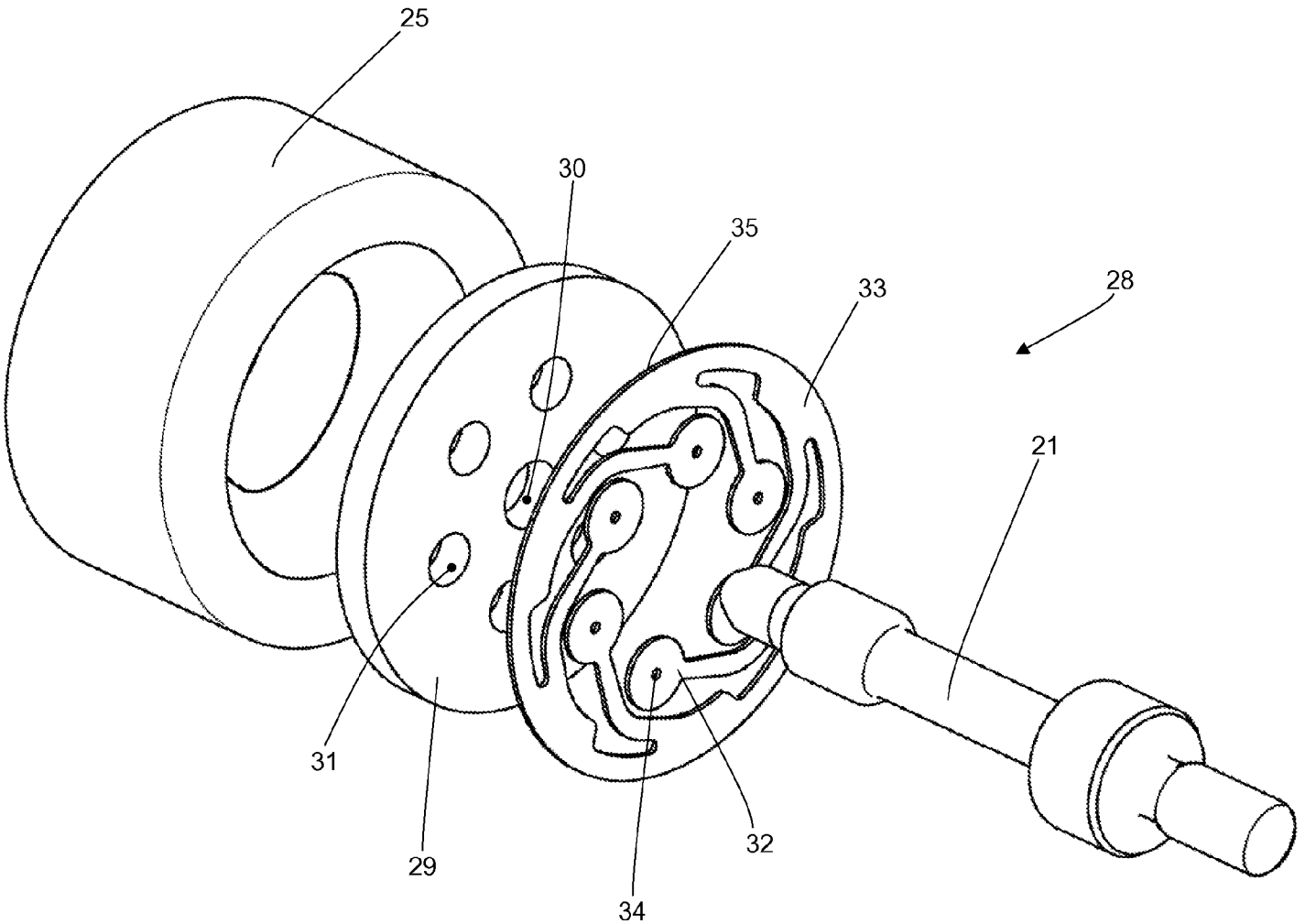
FIG. 6 is an exploded perspective view of the movable equipment of FIG. 4.
Figure 7:
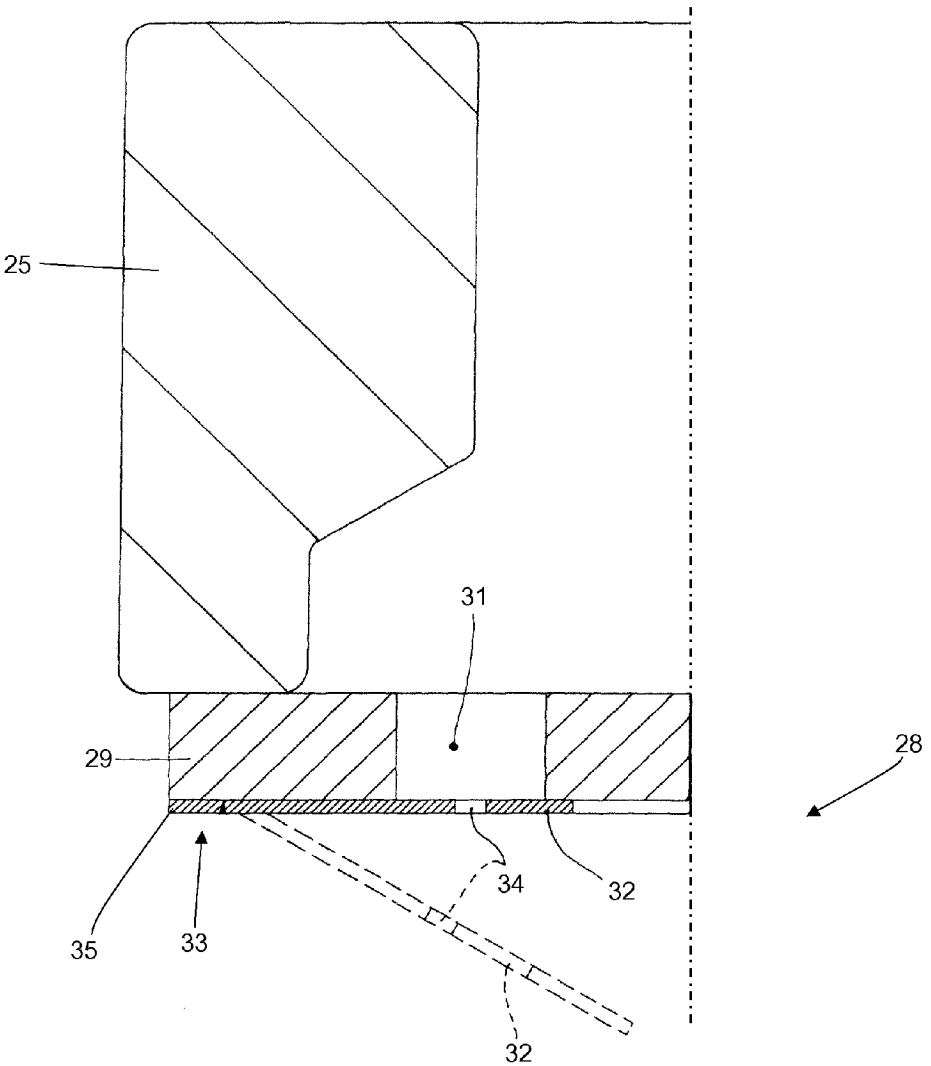
FIG. 7 is a cutaway view of a part of the movable equipment of FIG. 4 highlighting two different positions taken by a valve element of a hydraulic brake coupled to the movable equipment.

As shown in FIG. 3, the electromagnetic actuator 22 comprises a spring 23 that keeps the control rod 21 in the "active" position and an electromagnet 24 that is piloted by the control unit 7 and adapted to move the control rod 21 to the "passive" position by magnetically attracting a ferromagnetic anchor 25 integral with the control rod 21. When the electromagnet 24 is energised, the control rod 21 is returned to the "passive" position, and the communication between the suction channel 17 and pumping chamber 14 may be interrupted by the closing of the suction valve 18. The electromagnet 24 comprises a fixed magnetic armature 26 (or magnetic bottom) that is surrounded by a coil 27. When crossed by an electrical current, the coil 27 generates a magnetic field that magnetically attracts the anchor 25 toward the magnetic armature 26. The control rod 21 and anchor 25 together form movable equipment of the flow-rate-adjustment device 6 that axially moves between the "active" and "passive" positions under the control of the electromagnetic actuator 22. The anchor 25 and magnetic armature 26 define a centrally perforated annular form to present an empty central space in which the spring 23 is accommodated.

The electromagnetic actuator 22 comprises a one-way hydraulic brake 28 that is integral with the control rod 21 and slows the movement of the movable equipment (i.e., the control rod 21 and anchor 25) only when the movable equipment moves toward the "active" position (i.e., the hydraulic brake 28 does not slow the movement of the movable equipment when the movable equipment moves toward the "passive" position).

The hydraulic brake 28 comprises a disc 29 that is mechanically integral with the anchor 25 (i.e., laterally welded to the anchor 25) and defines a central through-hole 30 that receives an upper portion of the control rod 21. The control rod 21 is made mechanically integral with the disc 29 by a welding. In this way, the disc 29 of the hydraulic brake 28 also has the structural function of creating the mechanical connection between the control rod 21 and armature 25. Moreover, the disc 29 of the hydraulic brake 28 also has a further structural function since one end of the spring 23 rests on the disc 29 and, thus, the disc 29 transmits the elastic thrust of the spring 23 to the movable equipment. The disc 29 defines a plurality of peripheral through-holes 31 that are uniformly distributed around the central hole 30 adapted to allow the fuel flow.

As shown in FIGS. 4 through 7, each peripheral through-hole 31 of the disc 29 is coupled to a corresponding valve element 32 that defines a different permeability to the passage of the fuel as a function of the direction of the passage of the fuel itself through the peripheral through-hole 31. In particular, the permeability of each valve element 32 to the passage of the fuel is minimal when the movable equipment moves toward the active position and maximum when the movable equipment moves toward the "passive" position. The valve elements 32 have corresponding flaps of an elastic lamina 33 (i.e., elastically deformable) that is partially fixed to the face of the disc 29 facing the suction valve 18 (in particular, the elastic lamina 33 is fixed to the disc 29 at a peripheral edge thereof). In other words, an outer edge of the elastic lamina 33 is welded by an annular welding to the face of the disc 29 facing the suction valve 18 whereas the inner portion of the elastic lamina 33 having the flaps (i.e., the valve elements 32) is released from the disc 29 and, thus, free to move (as a consequence of an elastic deformation) with respect to the disc 29 itself.

Each valve element 32 (i.e., flap of the elastic lamina 33) defines a small-sized through-hole 34 that is aligned with the corresponding peripheral through-hole 31 (in other words, the through-hole 34 defines a diameter significantly smaller than that of the corresponding peripheral through-hole 31).

When the movable equipment moves toward the "passive" position, the disc 29 must dislodge (move) a part of the fuel that is present inside the suction channel 17. And, during the movement of the movable equipment, the thrust generated by the fuel existing between the disc 29 and magnetic armature 26 determines an elastic deformation of the flaps (i.e., the valve elements 32) that move away from the disc 29, thus leaving the fuel passage through the peripheral through-holes 31 substantially free (as shown with a dashed line in FIG. 7). Conversely, when the movable equipment moves toward the "active" position, the disc 29 must dislodge (move) a part of the fuel that is present inside the suction channel 17. And, during the movement of the movable equipment, the thrust generated by the fuel existing between the disc 29 and suction valve 18 pushes the flaps (i.e., the valve elements 32) against the disc 29, sealing the peripheral through-holes 31 (i.e., preventing the fuel-flow through the peripheral through-holes 31), except for the passage allowed through the through-holes 34 (as shown with a solid line in FIG. 7).

Since the diameter of the through-holes 34 is much smaller than that of the peripheral through-holes 31, it is apparent that the hydraulic brake 28 generates a high braking force when the control rod 21 moves toward the "active" position (i.e., the fuel can only flow through the passage gap of the through-holes 34) and a negligible braking force when the control rod 21 moves toward the "passive" position (i.e., the fuel can flow through the whole passage gap of the peripheral through-holes 31).

According to an embodiment, the elastic lamina 33 comprises an outer crown 35 that is fixed to the disc 29 by welding (for example, laser spot welding). The flaps (i.e., the valve elements 32) extend from the crown 35 inward, and each of them comprises a circular sealing element connected to the outer crown 35 by a thin stem (i.e., presenting a length much longer than the width to be able to be elastically deformed). According to an embodiment, the elastic lamina 33 is made from an elastic steel sheet that is processed by photo-etching. Thereafter, the deformable lamina 33 is connected to the processed disc 29 by moulding by a laser spot welding.

When in use, the movable equipment (i.e., the control rod 21 and anchor 25) of the adjustment device 6 moves toward the "passive" position (thus, moving away from the "active" position and allowing the suction valve 18 to close to start feeding fuel under pressure to the common rail 3). The hydraulic brake 28 generates a negligible braking force and, therefore, does not determine any slowing of the movable equipment nor provide any contribution to the reduction of the kinetic energy of the movable equipment upon the impact against the magnetic armature 26. On the one hand, the hydraulic brake 28 does not slow the movement of the movable equipment, thus allowing the movable equipment to quickly respond to the commands of the control unit 7 (movement toward the "passive" position has a significant effect on the operation of the high-pressure pump 4 and must, therefore, be as quick as possible to facilitate and improve control). And, on the other hand, in this movement, the reduction of the kinetic energy of the movable equipment upon the impact against the magnetic armature 26 can be effectively and efficiently obtained even by just a software control of the piloting current of the electromagnet 24 (i.e., action of the hydraulic brake 28 is not required; on the contrary, it could complicate the software control of the piloting current of the electromagnet 24).

When in use, the movable equipment (i.e., the control rod 21 and anchor 25) of the adjustment device 6 moves toward the "active" position. The hydraulic brake 28 generates a high braking force that considerably reduces the moving speed of the movable equipment and, thus, greatly reduces the kinetic energy of the movable equipment upon impact against the suction valve 18 (the kinetic energy varies with the square of the speed). On the one hand, it allows the kinetic energy of the movable equipment to be greatly reduced upon impact against the suction valve 18 (a reduction that cannot be effectively obtained by a software control of the piloting current of the electromagnet 24). And, on the other hand, it has no negative impact on the control performance since the movement toward the "active" position has no immediate effect on the operation of the high-pressure pump 4 and can, therefore, be carried out very slowly as well.

It is important to note that the hydraulic brake 28 generates a braking force only when the movable equipment (i.e., the control rod 21 and anchor 25) of the adjustment device 6 is moving (i.e., when the adjustment device 6 is stationary, the hydraulic brake 28 generates no braking force). Accordingly, it is ensured that the movable equipment always reaches the "active" position (i.e., the hydraulic brake 28 is not physically capable of "stopping" the movable equipment before reaching the "active" position), and is always braked in the movement thereof toward the "active" position.

With the high-pressure pump 4, the kinetic energy of the movable equipment (i.e., the control rod 21 and anchor 25) of the adjustment device 6 upon impact against the suction valve 18 is significantly limited, thus significantly reducing the noise generation subsequent to the impact. Also, with the high-pressure pump 4, the movement toward the "passive" position is not braked, thus ensuring a high response speed to the control. Furthermore, the high-pressure pump 4 is simple and inexpensive to make since the hydraulic brake 28 consists of only two parts (the disc 29 and lamina 33) that may be made through simple mechanical operations.

It should be appreciated by those having ordinary skill in the related art that the high-pressure pump 4 has been described above in an illustrative manner. It should be so appreciated also that the terminology that has been used above is intended to be in the nature of words of description rather than of limitation. It should be so appreciated also that many modifications and variations of the high-pressure pump 4 are possible in light of the above teachings. It should be so appreciated also that, within the scope of the appended claims, the high-pressure pump 4 may be practiced other than as specifically described above.

What is claimed is:

1. A fuel pump (4) for a direct-injection system provided with a common rail (3), said fuel pump (4) comprising:

a pumping chamber (14) defined in a main body (12);

a piston (15) that is mounted in a sliding manner inside said pumping chamber (14) to cyclically vary volume of said pumping chamber (14);

a suction channel (17) connected to said pumping chamber (14) and regulated by a suction valve (18);

a delivery channel (19) connected to said pumping chamber (14) and regulated by a delivery valve (20); and a flow-rate-adjustment device (6) that is mechanically coupled to said suction valve (18) to keep, when necessary, said suction valve (18) substantially open during pumping of said piston (15) and includes a control rod (21) that is coupled to said suction valve (18) and an electromagnetic actuator (22) that acts on said control rod (21) and has a one-way hydraulic brake (28) that is integral to and substantially slows movement of said control rod (21).

2. A fuel pump (4) according to claim 1, wherein said electromagnetic actuator (22) moves said control rod (21) between a "passive" position, in which said control rod (21) allows said suction valve (18) to close, and an "active" position, in which said control rod (21) does not allow said suction valve (18) to close, and said hydraulic brake (28) generates a high-breaking force when said control rod (21) moves toward the "active" position and generates a negligible breaking force when said control rod (21) moves toward the "passive" position.

3. A fuel pump (4) according to claim 1, wherein said hydraulic brake (28) has a disc (29) provided with at least one first through-hole (31) and a valve element (32) that is coupled to said first through-hole (31) and defines a different permeability to passage of fuel as a function of direction of the passage of the fuel through said first through-hole (31).

4. A fuel pump (4) according to claim 3, wherein said valve element (32) has an elastic lamina (33) that is partially fitted to said disc (29) and defines a second through-hole (34) of substantially small dimensions substantially aligned with said first through-hole (31).

5. A fuel pump (4) according to claim 4, wherein said disc (29) defines a plurality of first through-holes (31) that are substantially uniformly distributed and said lamina (33) is fitted to said disc (29) in correspondence to a peripheral edge thereof and provided with a series of flaps each of which is coupled to respective said second through-hole (34).

6. A fuel pump (4) according to claim 3, wherein said electromagnetic actuator (22) has a spring (23) that pushes on said control rod (21) and an electromagnet (24) provided with an anchor (25), which is integral to said control rod (21) and defines a centrally perforated annular form, and a fixed magnetic armature (26), which magnetically attracts said anchor (25), and said disc (29) of said hydraulic brake (28) is substantially laterally integral to said anchor (25) and centrally integral to said control rod (21) to establish a mechanical connection between said anchor (25) and control rod (21).

7. A fuel pump (4) according to claim 6, wherein said disc (29) of said hydraulic brake (28) defines a third through-hole (30), which is substantially centrally arranged and receives an upper portion of said control rod (21), and a plurality of first through-holes (31), which are arranged substantially around said third through-hole (30).

* * * * *